US008342063B2

(12) United States Patent
Stanton

(10) Patent No.: US 8,342,063 B2
(45) Date of Patent: Jan. 1, 2013

(54) OPEN-ENDED RATCHET WRENCH

(76) Inventor: John L. Stanton, Clarksville, TN (US)

( * ) Notice: Subject to any disclaimer, the term of this patent is extended or adjusted under 35 U.S.C. 154(b) by 355 days.

(21) Appl. No.: 12/646,335

(22) Filed: Dec. 23, 2009

(65) Prior Publication Data

US 2011/0146463 A1 Jun. 23, 2011

(51) Int. Cl.
*B25B 13/46* (2006.01)
*B25B 13/08* (2006.01)

(52) U.S. Cl. ..... 81/179; 81/186

(58) Field of Classification Search ..... 81/179, 81/91.1, 91.2, 92, 106, 109, 111, 186
See application file for complete search history.

(56) References Cited

U.S. PATENT DOCUMENTS

| | | | | |
|---|---|---|---|---|
| 109,946 | A | 12/1870 | Rockwell et al. | |
| 385,595 | A * | 7/1888 | Chappell | 81/179 |
| 614,696 | A | 11/1898 | Brown | |
| 629,835 | A | 8/1899 | Wertsbaugher | |
| 731,338 | A | 6/1903 | Cattelle | |
| 869,942 | A | 10/1907 | Hill | |
| 1,320,668 | A * | 11/1919 | Askman | 81/179 |
| 1,335,451 | A | 3/1920 | Moore | |
| 1,376,195 | A | 4/1921 | Fernandez | |
| 1,378,243 | A | 5/1921 | Kracke | |
| 1,406,467 | A | 2/1922 | Matthey | |
| 1,444,216 | A * | 2/1923 | Sorensen | 81/179 |
| 1,489,458 | A | 4/1924 | Petersen | |
| 1,732,000 | A | 10/1929 | Colognori | |
| 1,827,121 | A | 10/1931 | Trane | |
| 1,838,481 | A | 12/1931 | Guoka | |
| 1,964,134 | A | 6/1934 | Oberti | |
| 2,047,548 | A | 7/1936 | Colognori et al. | |
| 2,193,571 | A | 3/1940 | Siemund | |
| 2,278,208 | A | 3/1942 | Minnis | |
| 2,426,191 | A | 4/1947 | Feiring | |
| 2,534,086 | A | 12/1950 | Vosbikian et al. | |
| 2,712,259 | A | 7/1955 | Cowell | |
| 2,795,160 | A | 6/1957 | Blasdell | |
| 2,797,600 | A * | 7/1957 | Beaver | 81/179 |
| 2,980,457 | A | 4/1961 | Page | |
| 3,079,624 | A | 3/1963 | Neal | |
| 3,085,270 | A | 4/1963 | Vosbikian et al. | |
| 3,395,415 | A | 8/1968 | Leland | |

(Continued)

FOREIGN PATENT DOCUMENTS

AT 192080 9/1957

(Continued)

OTHER PUBLICATIONS http://www.dess.com.tw/index.asp, downloaded on Mar. 29, 2010.

(Continued)

*Primary Examiner* — David B Thomas
(74) *Attorney, Agent, or Firm* — Fish & Richardson P.C.

(57) ABSTRACT

Among other things, an open-ended wrench comprises a wrench head defining an opening to receive a work piece. The wrench head comprises a first jaw including at least a first surface to engage with a surface of the work piece, a second jaw including a first curved surface facing the opening, and a plate mounted on the second jaw and movable relative the second jaw. The plate comprises at least a second surface to engage with another surface of the work piece. The plate also comprises a second curved surface engaging the first curved surface and being slidable against the first curved surface.

21 Claims, 5 Drawing Sheets

U.S. PATENT DOCUMENTS

| | | | | | |
|---|---|---|---|---|---|
| 3,537,123 | A | | 11/1970 | Leland | |
| 3,568,237 | A | | 3/1971 | Rhodes | |
| 3,641,847 | A | * | 2/1972 | Horton | 81/111 |
| 3,695,125 | A | * | 10/1972 | Glass et al. | 81/179 |
| 3,766,591 | A | | 10/1973 | Soito | |
| 3,892,150 | A | * | 7/1975 | Horton | 81/179 |
| 3,909,870 | A | | 10/1975 | Leland | |
| 3,921,474 | A | * | 11/1975 | Dyck et al. | 81/91.2 |
| 3,927,582 | A | | 12/1975 | Hertelendy et al. | |
| 4,158,975 | A | * | 6/1979 | DeSousa | 81/179 |
| 4,204,440 | A | | 5/1980 | Del Prete et al. | |
| 4,236,270 | A | | 12/1980 | Mavis | |
| 4,312,093 | A | | 1/1982 | Raab | |
| 4,455,705 | A | | 6/1984 | Graham | |
| 4,488,459 | A | | 12/1984 | Bailey et al. | |
| 4,574,665 | A | | 3/1986 | Blachly | |
| 4,644,830 | A | | 2/1987 | Bailey et al. | |
| 4,718,315 | A | | 1/1988 | Nitschmann | |
| 4,787,277 | A | | 11/1988 | Myers | |
| 4,848,193 | A | | 7/1989 | Wylie, III | |
| 4,893,370 | A | | 1/1990 | Klotz | |
| 4,926,720 | A | | 5/1990 | Srzanna | |
| 5,148,725 | A | | 9/1992 | Botha | |
| 5,175,902 | A | | 1/1993 | Samuelsson | |
| 5,255,405 | A | | 10/1993 | Samuelsson et al. | |
| 5,287,777 | A | * | 2/1994 | Kolodziej | 81/179 |
| 5,333,347 | A | | 8/1994 | Stranders | |
| 5,347,676 | A | | 9/1994 | Saitoh | |
| 5,427,004 | A | | 6/1995 | Monaco | |
| 5,456,143 | A | | 10/1995 | Stanton | |
| 5,533,428 | A | | 7/1996 | Pradelski | |
| 5,553,520 | A | | 9/1996 | Jacobs | |
| 5,582,082 | A | | 12/1996 | Gajo | |
| 5,829,327 | A | | 11/1998 | Stanton | |
| 6,223,630 | B1 | | 5/2001 | Stanton | |
| 6,412,372 | B1 | | 7/2002 | Hsu | |
| 7,024,971 | B2 | | 4/2006 | Stanton | |
| 7,028,590 | B2 | | 4/2006 | Mu | |
| 7,077,035 | B1 | | 7/2006 | Huang | |
| 7,111,529 | B2 | | 9/2006 | Pradelski | |
| 7,255,026 | B1 | | 8/2007 | Lee | |
| 7,270,035 | B2 | | 9/2007 | Lu | |
| 7,827,887 | B2 | * | 11/2010 | Lee | 81/179 |
| 7,878,095 | B2 | * | 2/2011 | Wu | 81/179 |
| 2010/0071516 | A1 | * | 3/2010 | Wu | 81/176.1 |

FOREIGN PATENT DOCUMENTS

| | | |
|---|---|---|
| DE | 449525 | 9/1927 |
| FR | 568058 | 12/1923 |
| FR | 567081 | 2/1924 |
| GB | 9440 | 0/1908 |
| GB | 1107458 | 3/1968 |
| JP | 90211713 | 7/2001 |
| TW | 201010826 | 9/1997 |
| WO | WO 89/10721 | 11/1989 |

OTHER PUBLICATIONS http://www.zwrench.com, at least as early as Jan. 4, 2010.

Action and Response History in U.S. Appl. No. 10/386,917, as retrieved from the file on Aug. 9, 2010.

Action and Response History in U.S. Appl. No. 09/036,349, as retrieved from the file on Aug. 9, 2010.

Action and Response History in U.S. Appl. No. 08/728,627, as retrieved from the file on Aug. 9, 2010.

Action and Response History in U.S. Appl. No. 09/114,628, as retrieved from the file on Sep. 27, 2010.

Action and Response History in U.S. Appl. No. 09/251,050, as retrieved from the file on Sep. 27, 2010.

* cited by examiner

OPEN-ENDED RATCHET WRENCH

TECHNICAL FIELD

This description relates to an open-ended ratchet wrench.

BACKGROUND

There are many occasions when it is desirable to apply a torque to a work piece (such as nuts, bolts, and in-line hydraulic fittings) in order to, for example, rotate the work piece with respect to a threaded member. Two well-known tools for rotating work pieces are ratchet wrenches and open-ended crescent wrenches. Ratchet wrenches are typically close-ended devices that completely encircle the work piece and are thus installed on the work piece from the top (or bottom, depending upon the orientation of the work piece). Open-ended wrenches can be installed from the side of the work piece.

Open-ended wrenches are useful in small work spaces where there may only be sufficient room to install the wrench from the side. In some situations, confined work spaces may provide insufficient space to accommodate the ratchet mechanism of close-ended ratchet wrenches. Open-ended wrenches are also useful in tightening/loosening in-line fittings of hydraulic or fuels lines, which are configured to receive a wrench from the side.

SUMMARY

In one aspect, the description features an open-ended wrench comprising a wrench head defining an opening to receive a work piece. The wrench head comprises a first jaw including at least a first surface to engage with a surface of the work piece, a second jaw including a first curved surface facing the opening, and a plate mounted on the second jaw and movable relative the second jaw. The plate comprises at least a second surface to engage with another surface of the work piece. The plate also comprises a second curved surface engaging the first curved surface and being slidable against the first curved surface.

The opening is partially enclosed and there is an entrance between the first jaw and the plate to enable the work piece to be received. The first and the second curved surfaces have the same curvature. The second jaw further comprises a supporting member extending from the first curved surface towards the opening. The plate includes a proximal end and a distal end, and the plate comprises plate members that are separated by an open space at the proximal end and joined at the distal end. The supporting member of the second jaw is accommodated in the open space between the plate members of the plate. The supporting member comprises a slot and the wrench head further comprises a pin to be fastened to the plate members and to pass through the slot to attach the plate to the second jaw. The slot has a length that enables the pin to move within the slot. The slot is oriented so that the movement of the pin causes the second curved surface to slide against the first curved surface without disengaging the first and the second curved surfaces. The pin moves within the slot without contacting the supporting member. Each plate member includes a slot and the wrench head further comprises a pin to be fastened to the supporting member and to pass through the slots of the plate members. Each slot of the plate member has dimensions larger than the dimensions of the pin. The wrench head further comprises a spring having a first end attached to the wrench head and a second end to engage the plate. The first and the second surfaces are planar surfaces. The first jaw and the plate define a six-point design. The first and the second surfaces are corrugated. The first jaw and the plate define a twelve-point design. The first jaw is stationary relative to the second jaw.

In another aspect, the description features a method of making an open-ended wrench. The method comprises providing a base for a wrench head, the base including a first jaw and a second jaw that partially enclose an opening, the second jaw including a first curved surface facing the opening; and mounting a plate onto the second jaw, the plate being movable relative to the second jaw. Mounting the plate comprises engaging a second curved surface of the plate with the first curved surface of the second jaw, the second curved surface slidable against the first curved surface. Mounting the plate can further comprise engaging a spring attached to the base with the plate. Mounting the plate can further comprise fastening a pin to the plate and passing the pin through a slot defined in the second jaw, the pin movable within the slot.

Another aspect describes an apparatus comprising an open-ended wrench having an opening between a first jaw and a movable plate mounted on a second jaw and means for loading a work piece from an entrance between the first jaw and the movable plate into the opening. The movable plate is in a locked state and has a curved surface engaging and slidable against a curved surface of a second jaw. The curved surface of the movable plate slides against the curved surface of the second jaw to move the movable plate away from the locked state and increase a width of the entrance to load the work piece. After the work piece is loaded, the curved surface of the movable plate slides against the curved surface of the second jaw to allow the movable plate to return towards the locked state to grasp the work piece.

In another aspect, the description features an apparatus comprising means for loading a work piece into an opening defined by a first jaw and a movable plate mounted on a second jaw of an open-ended wrench. The work piece has at least a first surface to engage a surface of the first jaw and a second surface to engage a surface of the movable plate. The movable plate has a curved surface engaging a curved surface of the second jaw. The apparatus also includes means for turning the loaded work piece in a driving direction to into a first position. The work piece and the movable plate remain stationary relative to the first and the second jaw. The apparatus also includes means for ratcheting the loaded work piece in a ratcheting direction. The work piece remains stationary relative to the first position and to the movable plate At least a portion of the surface of the first jaw disengages the first surface of the work piece and the curved surface of the movable plate slides against the curved surface of the second jaw.

In another aspect, the description features an open-ended wrench comprising a first stationary jaw, a movable plate mounted on a second stationary jaw, a pin retaining the movable plate on the second stationary jaw, and means for transmitting forces from the movable plate to the second stationary jaw without having the force passing through the pin. Surfaces of the first stationary jaw and the movable plate partially surround an opening to receive a work piece in the open-ended wrench.

The details of one or more examples are set forth in the accompanying drawings and the description below. Further features, aspects, and advantages will be apparent from the description, drawings, and the claims.

DETAILED DESCRIPTION

Figure 1:
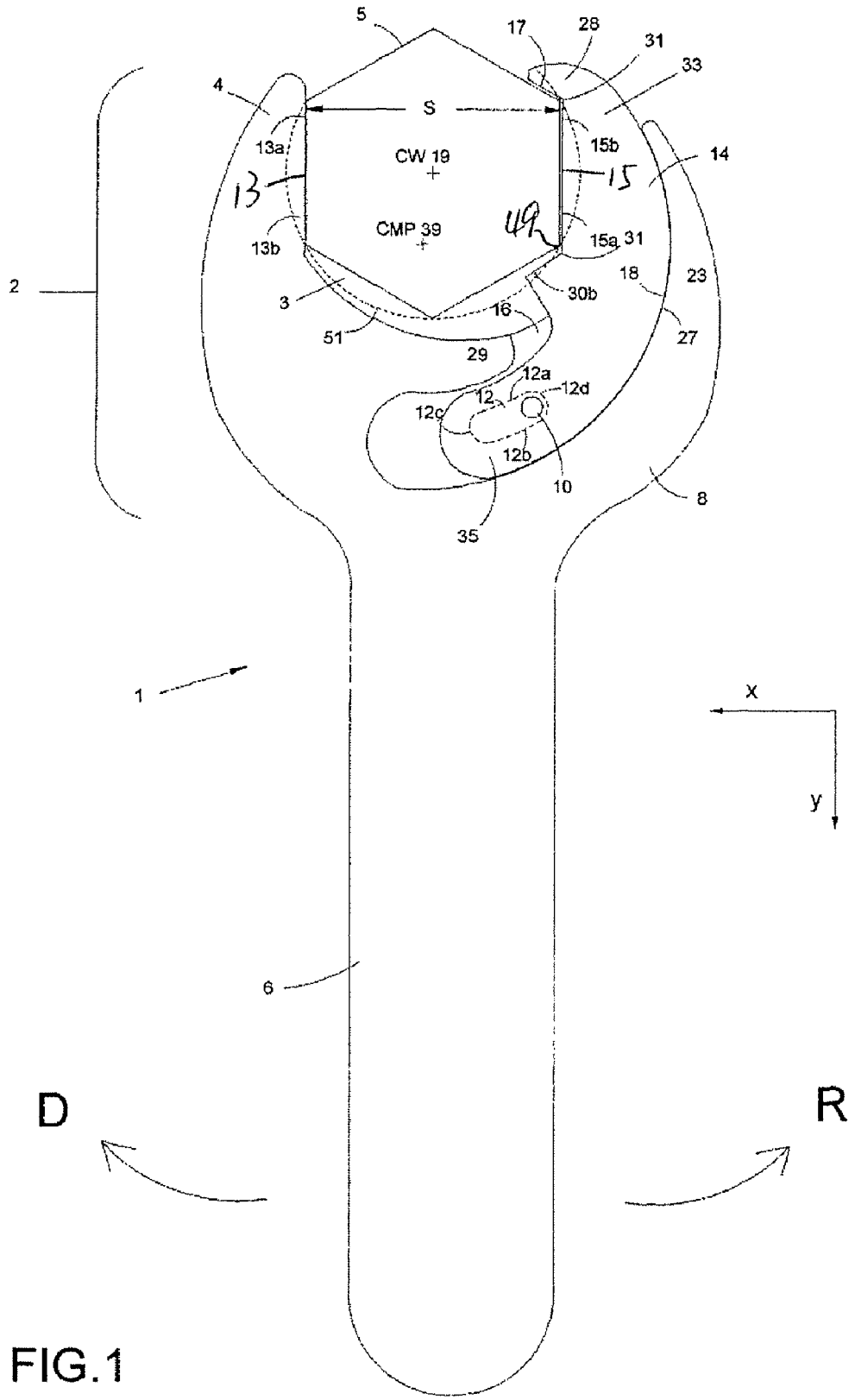
FIGS. 1, 5, and 6 are schematic top views of open-ended ratchet wrenches engaging a work piece.

Referring to FIG. 1, an open-ended ratcheted wrench 1 includes an elongated handle 6 and a head 2 defining an opening 3. A work piece 5 can be loaded, e.g., inserted, into the opening 3 along a direction y that is substantially in line with a longitudinal axis of the elongated handle 6. Such a loading is sometimes called loading from the side. Examples of the work piece 5 can include, e.g., a head of a bolt, a nut, or an in-line fitting. When loaded, portions of one or more surfaces of the work piece 5 engage one or more work piece engaging surfaces, e.g., surfaces 13, 15, 17, of the head 2. A user (not shown) can turn, e.g., within the x-y plane, the handle 6 to apply forces or torque to the work piece 5 through the engaged surfaces 13, 15, 17. The work piece 5 can turn around a center 19 (center of the work piece, or CW). The user can turn the handle 6 back (counterclockwise, in a resetting direction R) and forth (clockwise, in a driving direction D) continuously to turn the work piece 5 in the driving direction D, without unloading the work piece 5 from the opening 3. The operational mechanism of the wrench 1 is further discussed with respect to FIGS. 5 and 6.

Referring to FIGS. 1, 2, and 3A-3C, the open-ended wrench 1 has its structure shown. The head 2 includes a pair of stationary jaws 4, 8 connected to the handle 6. In some implementations, the stationary jaws 4, 8, and the handle 6 are formed, e.g., machined, as an integral member, e.g., in a solid piece. The jaw 4 includes an inner work piece engaging surface 13 facing the opening 3. The work piece engaging surface 13 is stationary relative to the wrench 1. The jaw 8 supports a movable plate 14 that carries the movable work piece engaging surface 15, 17. The work piece engaging surfaces 13, 15, 17 can be flat (FIG. 1) or corrugated (FIGS. 2 and 3A-3C).

Referring to FIG. 1, when the work piece 5 is fully loaded in the opening 3 of the wrench 1, the work piece engaging surfaces 13, 15, 17 engage the work piece 5 at an arc 51 (shown in dotted lines) of 270 degrees. The adjacent work piece engaging surfaces, e.g., surfaces 15, 17, meet at corner 31 with an angle of 120 degrees. The wrench 1 in FIG. 1 can accommodate hexagonal work piece 5 in a standard or 60 degree rotated position. Such an arrangement of the work piece engaging surfaces corresponds to a so-called six point design, because it will accommodate a six cornered hexagonal work piece. The work piece engaging surfaces 13, 15 have dimensions to engage opposing surfaces of the work piece 5 along the entire length of the surface. Surfaces 13, 15 are further divided into sections 13*a*,13*b* and 15*a*, 15*b*. When the handle 6 is turned in a driving direction, torque is transmitted to work piece 5 through surface sections 13*a*, 15*a*, 17. When handle 6 is turned in a ratcheting direction, work piece 5 remains stationary and pressure through surface sections 13*b*, 15*b* causes the moving plate 14 to partially disengage the surfaces 13, 15.

Referring to FIGS. 2 and 3A-3C, the work piece engaging surface 13, is cut with a notch 40 and surface 15 is cut with notch 42 to accommodate a work piece in a 30 degree rotated position. The wrench 1 thus is a so-called twelve point design because it can accommodate a hexagonal work piece in both a standard and a 30 degree rotated position. The work piece engaging surface 13 includes facets 13*a*, 13*b*, separated by the notch 40. The notch 40 includes facets (or surfaces) 40*a*, 40*b* meeting at the corner 31. Each facet (or surface) 13*a*, 40*b*, 40*a*, 13*b* meets with an adjacent facet (or surface) at an angle of 120 degrees. Other angles can also be used.

The work piece engaging surface 15 includes facets 15*a*, 15*b* separated by the notch 42. The notch 42 includes facets (or surfaces) 42*a*, 42*b* meeting at the corner 31. Each facet (or surface) 15*a*, 42*b*,42*a*, 15*b*, 17 meets with an adjacent facet (or surface) at an angle of 120 degrees. Other angles can also be used. When the wrench 1 captures the work piece 5 in a standard position and the handle 6 is turned in a driving direction, torque is applied to the work piece 5 through facets 13*a*, 15*a*, 17. When the wrench 1 captures the work piece 5 in a standard position and the handle 6 is turned in a ratcheting direction, work piece 5 remains stationary and pressure to facets 13*b*, 15*b* causes the moving plate 14 to at least partially disengage the surfaces 13, 15. The facet 17 is connected to an overhanging member 28 facing the opening 3.

Figure 2:
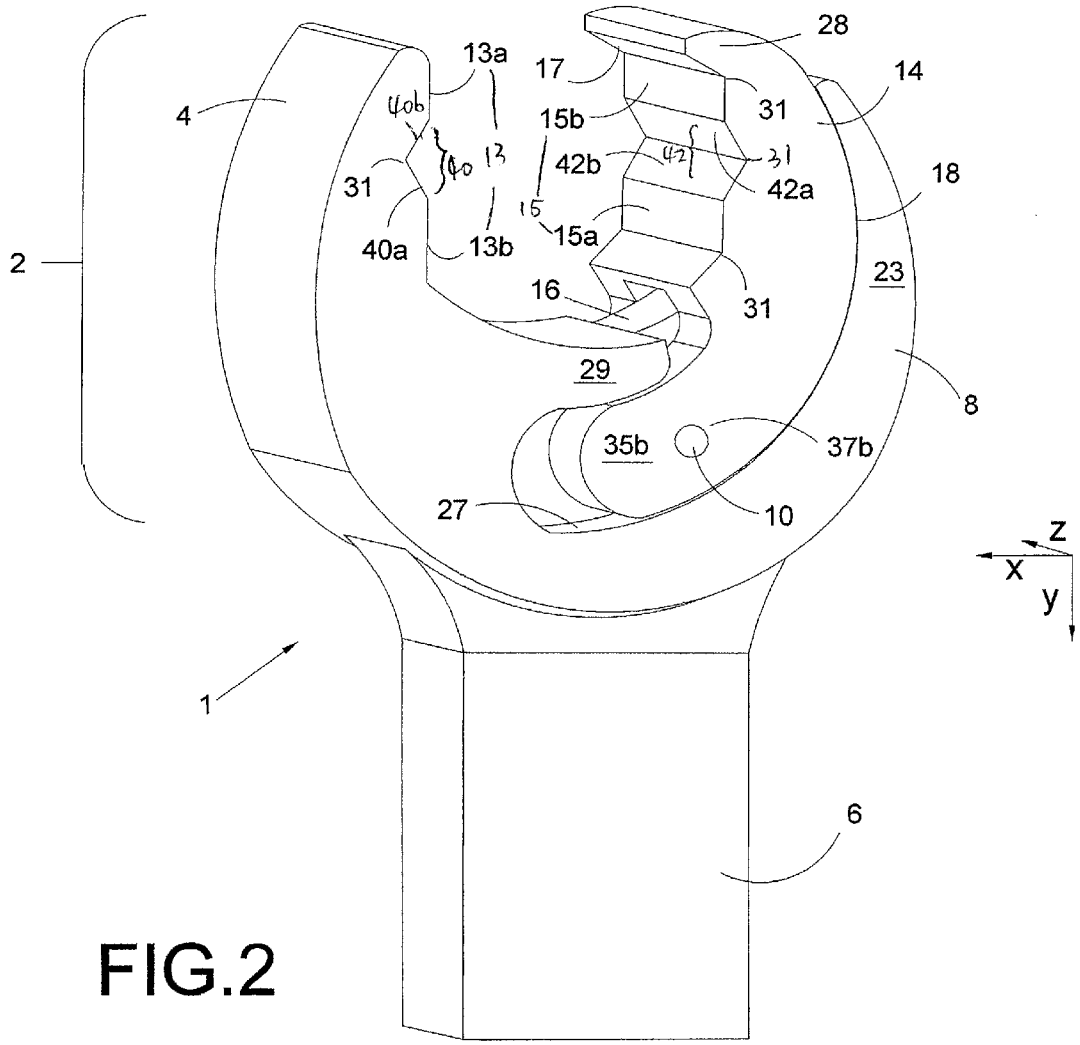
FIG. 2 is a perspective view of an open-ended ratchet wrench.
Figure 3C:
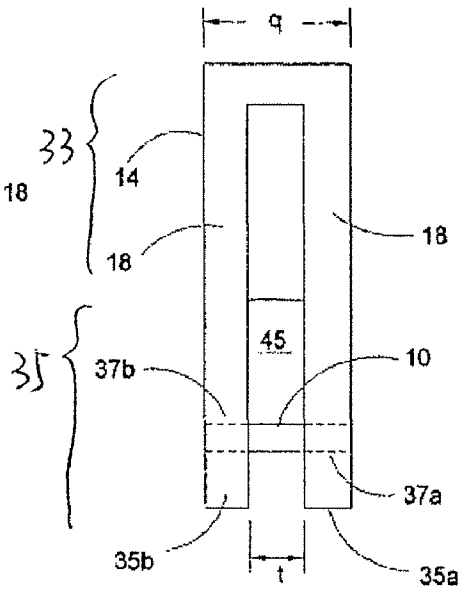
FIG. 3C is a schematic back view of a movable plate.
Figure 3B:
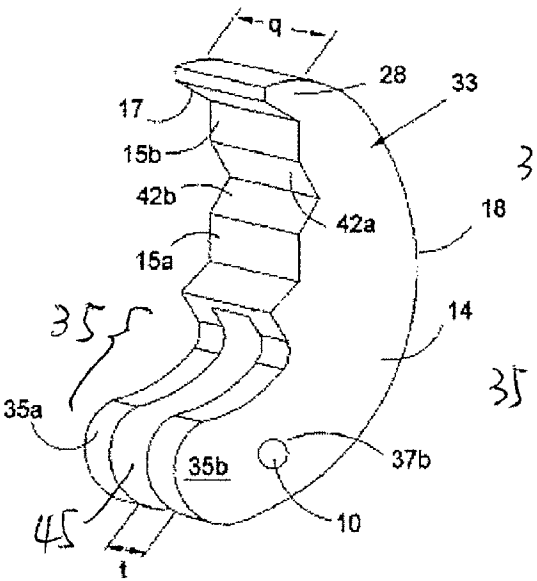
FIG. 3B is a perspective view of a movable plate.
Figure 3A:
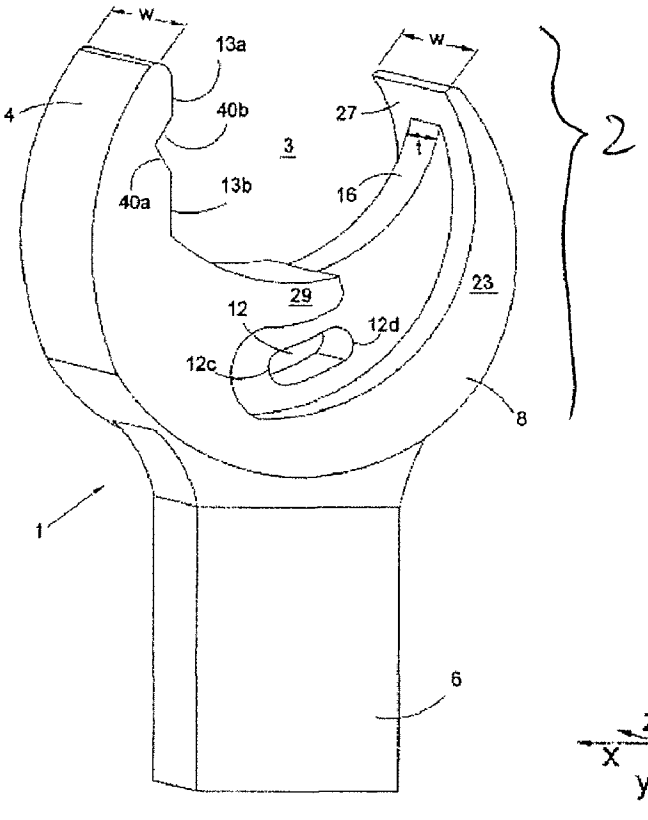
FIG. 3A is a perspective view of a portion of the open-ended ratchet wrench.

When the wrench 1 captures work piece 5 in a 30 degree rotated position and the handle 6 is turned in a driving direction, torque is transmitted to the work piece 5 through facets 40*a*, 42*a*. When wrench 1 captures the work piece 5 in a 30 degree rotated position and the handle 6 is turned in a ratcheting direction, work piece 5 remains stationary and pressure to surface 42*b* causes the moving plate 14 to at least partially disengage the surfaces 13, 15. Referring to FIGS. 2, 3A, and 3B, the movable plate 14 slides over a keel 16 of the jaw 8. A curved outer surface 18 of the movable plate 14 engages a curved inner surface 27 of an outer member 23 of the jaw 8. The curved outer surface 18 can slide along the inner surface 27 without disengagement. In some implementations, the outer member 23 of the jaw 8 can have the same thickness w as the jaw 4. The keel 16 extends between the inner surface 27 of the jaw 8 and the jaw 4, e.g., the overhanging member 29. The keel 16 has a thickness t that is a fraction of, e.g., about ⅓, the thickness w of the outer member 23 and is located, for example, at the center of the width w. The inner surface 27 is separated into two portions by the keel 16, each having a width of, e.g., about ⅓, thickness w of the outer member 23. In some implementations, the jaw 8 is larger and more curved than the jaw 4. The jaw 8 can also protrude from the handle 6 more than the jaw 4 does to accommodate the movable plate 14.

The movable plate 14 has a configuration that allows it to fit onto the jaw 8. For example, the plate 14 can be arcuately shaped or kidney shaped, and elongated. The movable plate 14 includes a solid, distal end 33 and a slotted proximal end 35 (FIGS. 3B and 3C), and can have a thickness q that is substantially the same as the thickness w of the jaw 8. The slotted proximal end 35 includes two plates 35*a* and 35*b* separated by a space 45.

When assembled onto the jaw 8, each plate 35*a*, 35*b*, of the movable plate 14 sits on either side of the keel 16 and the keel 16 is accommodated in the space 45. Both the curved surface 18 of the movable plate 14 and the curved inner surface 27 of the jaw 8 have the same curvature and are parts of a curved surface (or arc) that is centered about a center 39 of the movable plate 14 (CMP 39). The CMP 39 is offset from the center of the engaged work piece (CW19) (FIG. 1). When the movable plate 14 moves, surface 18 slides along the curved inner surface 27 and the two surfaces 18, 27 remain engaged. The keel 16 provides strength to the jaw 8 and prevents the movable plate 14 from shifting away from the jaw 4 during loading and operation of the work piece 5. The CMP 39 is offset from the CW 19 so that moveable plate 14 moves down towards handle 6 and away from CW 19 during ratcheting.

In addition to the work piece engaging surface 15, the movable plate 14 includes a cusp-shaped projection 28 near its distal end that provides the work piece engaging surface 17. The surface 17 extends at an angle of 120 degrees relative to they axis towards the opening 3. The projection 28 is short so as not to protrude excessively into the opening 3. The moveability of the plate 14 and the small size of projection 28 allow the wrench 1 to load the work piece 5 from the side. The additional engaging surface 17 provided by the projection 28 allows the wrench 1 to engage the work piece 5 well. For example, if the work piece 5 is made of a soft material, e.g., brass or aluminum, it is desirable to capture as many surfaces of the work piece 5 as possible.

The movable plate 14 is secured to the jaw 8 using a pin 10 (FIG. 1, FIGS. 3A-3C) that passes though an arcuate-shaped slot 12 in keel 16 and openings 37*a*, 37*b* in the plates 35*a*, 35*b* of the movable plate 14. The pin 10 can be secured to the movable plate through the openings 37*a*, 37*b* so that the movement of the pin 10 results in the movement of the movable plate 14. The arcuate-shaped slot 12 has an upper curved surface 12*a* and a lower curved surface 12*b*. Both curved surfaces 12*a*, 12*b* are co-centered with the curved surfaces 18, 27 at the CMP 39. The slot 12 is larger than the pin 10 which can therefore move between the curves 12*a*, 12*b* from one proximal end 12*c* to a distal end 12*d* of the slot 12, e.g., without contacting any surface of the slot 12. The movable plate 14 can be directed to move around the CMP 39 by the movement of the pin 10.

The work piece engaging surfaces of the jaw 4 and the moving plate 14 are laterally spaced from each other by a suitable distance to define the central opening space 3 for receiving the work piece 5. The space provided between the jaw 4 and the movable plate 14 can allow the work piece 5 to rotate with respect to the stationary jaws 4, 8 during ratcheting while remaining confined between the jaws 4, 8 (further discussed below). The wrench 1 does not have to be withdrawn from work piece 5 to rotate around the CW 19 of the work piece 5 during the ratcheting action.

Figure 4:
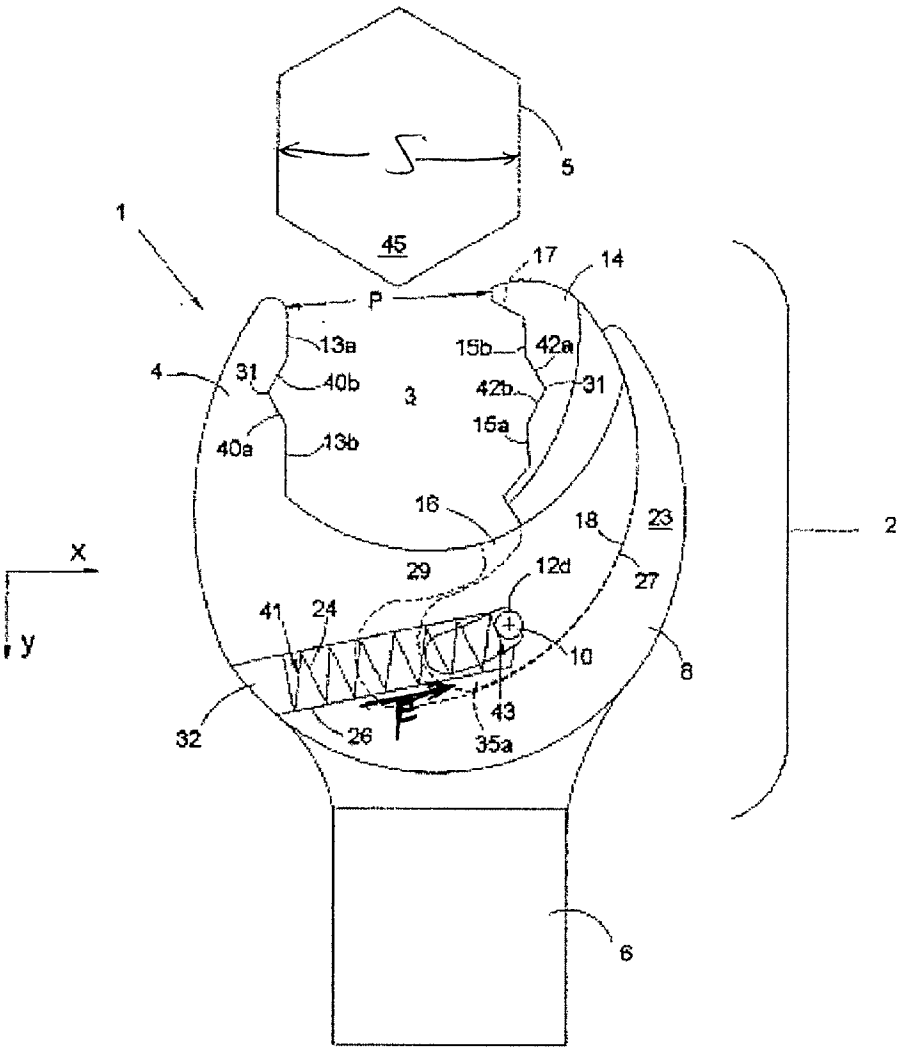
FIG. 4 is a schematic cross-sectional view of an open-ended wrench.

Referring to FIG. 4, a spring 24, e.g., a coil spring, is positioned in the base of the wrench head 2 at the distal end of the handle 6. One end 41 of the spring 24 is captured within a drilled hole 26 in the wrench head 2 and retained by a plug 32. The other end 43 of the spring 24 engages the pin 10 and exerts a force F on the pin 10 to push the movable plate 14 towards the opening 3. Spring 24 extends into the slot 12 and engages the portion of the pin 10 that is exposed in the open space 45 between the plates 35*a*, 35*b* (FIG. 3C). The plates 35*a* and 35*b* can be shaped and sized, e.g., elongated, to cover the slot 12, to prevent disengagement of the spring 24 and the pin 10, and to protect the spring 24 from dirt or debris.

When no other external forces (other than forces existed in the wrench 1) are applied to the movable plate 14, the spring force F pushes the pin 10 to rest at the distal end 12*d* of the slot 12. The wrench 1 is in a fully locked position without engaging the work piece 5. When the work piece 5 is held between the jaw 4 and the moving plate 14, the pin 10 is pushed away from the distal end 12*d* of the slot 12. In some implementations, the dimensions of the slot 12 and the properties of the spring 24, e.g., the spring constant, are selected such that during the operation on the work piece 5, the pin 10 does not substantially contact any surface 12*a*-12*d* of the slot 12. No substantial torque resulting from moving or turning the work piece 5 is transferred through the pin 10 to the jaws 4, 8. The pin 10 is used to retain the movable plate 14 and prevent it from falling out of head 2 of the wrench 1. Substantially all forces and torque are transferred through the engaged surface 18 of the movable plate 14 and the surface 27 of the jaw 8. The pin 10 is manufactured and used in the wrench 1 to endure prolonged wear.

The work piece 5 can be loaded by sliding the wrench 1 onto the work piece 5 from the side. Initially, an end 45 of the work piece 5 has a width S that is larger than the opening P of head 2. The user can force the work piece 5 to move forward towards the opening 3 by pushing the movable plate 14 against the spring force F. For example, the moving plate 14 and the pin 10 can be pushed downwards around the CMP 39 to make room for the work piece 5 to enter the space 3. The spring 24 then pushes against the pin 10 and the movable plate 14 returns to the locked state to grasp the loaded work piece 5.

Figure 6:
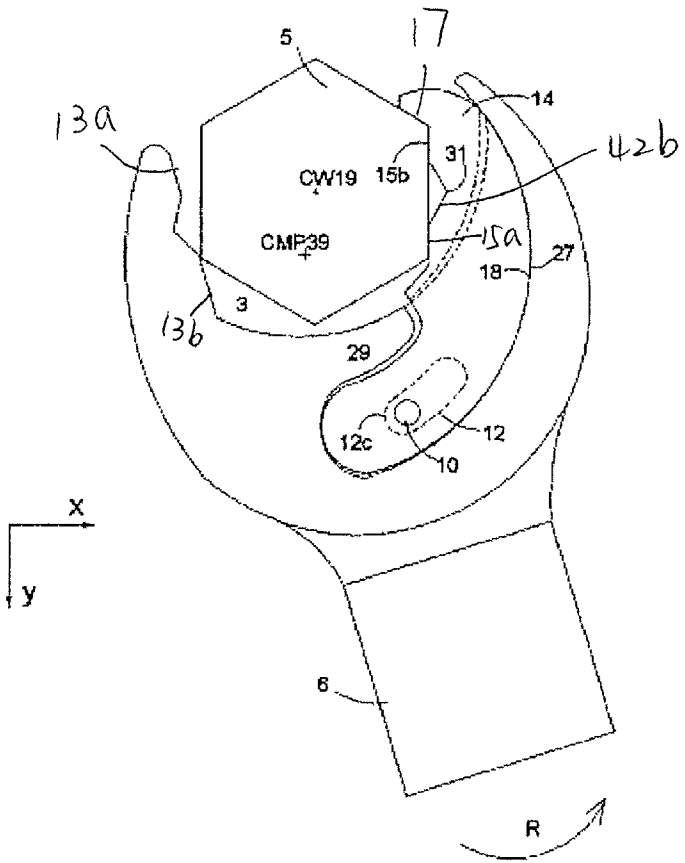
Figure 5:
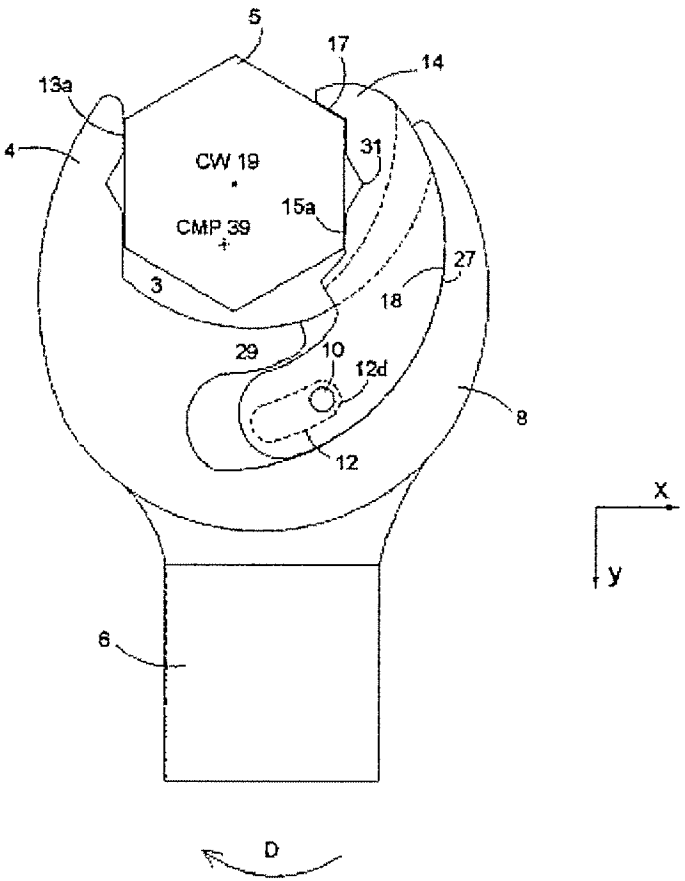

Referring to FIGS. 5 and 6, the driving (FIG. 5) and ratcheting (FIG. 6) operations of the wrench 1 are shown. The user can drive the work piece 5 by continuously turning the wrench handle 6 alternately in the driving direction D (clockwise, FIG. 5) and the ratcheting direction R (counterclockwise, FIG. 6) without withdrawing the wrench 1 from the work piece 5. During the turn in the driving direction D, the work piece 5 turns and the movable plate 14 remains stationary relative to the stationary jaws 4, 8. During the turn in the ratcheting direction R, the work piece 5 is stationary and the movable plate 14 slides towards the wrench handle 6.

Referring to FIG. 5, the work piece 5 is loaded in the opening 3 of the wrench 1. When the user turns the wrench 1 in the driving direction D (clockwise), the stationary jaws 4, 8 receive a torque from the user's operation to rotate in the driving direction D. The jaw 4 transfers the torque directly to the work piece 5 through the engaged work piece engaging surface 13*a* and the surfaces of the work piece 5 to rotate the work piece in the driving direction D. On the opposite side of the jaw 4, the jaw 8 transfers rotating torque through the surface 27 to the surface 18 of the moving plate 14. The work piece engaging surfaces 15*a*, 17 of the movable plate 14 then transfer a torque onto the work piece 5 to rotate the work piece in the driving direction D. The turning of the wrench 1 urges the movable plate 14 to move with respect to the stationary jaws 4, 8 in a direction opposite to the direction D. This urged motion is prevented by the engagement of the surface 18 against the surface 27 of the jaw 8. The movable plate 14 remains in the locked state and is stationary with respect to the jaws 4, 8. The torques transferred from the jaw 4 and the movable plate 14 turns the work piece 5 in the driving direction D.

In the 12 point wrench shown in FIGS. 3 and 5, when the work piece 5 is in a 30 degree rotated position, torque is transferred to the work piece 5 through the surface 40*a* of jaw 4 and 42*a* of moving plate 14.

Referring to FIG. 6, the wrench 1 is rotated in a ratcheting direction R (counterclockwise). The surfaces of the work piece 5 exerts a force on the engaged surface 15*b* of the movable plate 14. The force pushes the movable plate 14 against the spring 24 (FIG. 4). The pin 10 slides downwards towards the proximal end 12*c* of the slot 12 and the plate 14 slides downwards along the surface 27 of the jaw 8. The space 3 between the stationary jaw 4 and the movable plate 14 increases, which allows the wrench 1 to ratchet around the work piece 5.

In the 12 point configuration with the work piece 5 in a 30 degree rotated position, the surface of the work piece 5 exerts forces to the movable plate 14 through the surface 42*b* when the wrench 1 is rotated in a ratcheting position.

When the handle 6 is first rotated in the ratcheting direction R, the pin 10 moves through slot 12 towards the proximal end 12*c*, and the surface 18 slides against the surface 27 of the jaw 8. The movable plate 14 moves from the locked state (FIG. 5) to an unlocked state. Therefore, as the handle 6 is rotated in the ratcheting direction R, the movable plate 14 rotates spirally with respect to the stationary jaws 4, 8. The spiraling motion of the movable plate 14 is constrained by the movement of the pin 10 and the surface 18 against the surface 27.

The location of the CMP 39 and the orientation of the slot 12 and the surfaces 18, 27 are chosen so that the movable plate 14 can move downwards and outwards relative to the work piece 5. The wrench 1 can rotate around the work piece 5 during the ratcheting operation and yet still have sufficient clearance, so that the corners of work piece 5 do not bind against the work piece engaging surfaces 13, 15. The surfaces 13, 15, 17 of the movable plate 14 and the jaw 4 slide over the surfaces of the work piece 5, allowing the work piece to remain stationary.

In the six-point design shown in FIG. 1, approximately 60 degrees of handle rotation is required to ratchet the jaw 4 and the movable plate 14 around one corner 49 of the hexagonal work piece 5. As each corner of the work piece 5 passes across the flat surface 15 into an adjacent cusp 31, the spring force on the movable plate 14 from the spring 24 causes the movable plate 14 to return to the position shown in FIG. 5. In the twelve-point design shown in other figures, only 30 degrees of rotation is required before corners of the work piece 5 have moved into an adjacent cusp 31 on the jaw 4 and/or on the moving plate 14.

The driving and ratcheting directions R and D can be reversed by turning the wrench about they axis by 180 degrees, so that in a top view, the jaw 4 is on the right side of the work piece 5. In this arrangement, the driving direction D is counterclockwise and the ratcheting direction R is clockwise.

Components of the wrench 1 can be readily manufactured and assembled. Materials suitable for use in the components of the wrench 1 include tool steel, hardened steel, or others. Different components, e.g., the stationary jaw 4, 8, and the movable plate 14 can be made of the same or different material(s). The wrench 1 can be scaled up or down in size and enlarged or miniaturized with respect to standard and metric sized open-ended wrenches. In some implementations, the stationary jaws of the wrench can receive movable plates having different sizes to provide openings 3 with different sizes. A movable plate with a suitable size can be selected and assembled with the jaws of the wrench to accommodate work pieces having a particular size and shape without use a different wrench.

Still other embodiments are within the scope of the following claims.

For example, the wrench may have an elongated plate with more or fewer work piece engaging surfaces. The movable plate and the stationary jaws can have other shapes. The slot and pin may be reversed, so that the pin is defined in the keel and the slot is defined in the proximal end of movable plate.

The wrench handle does not have to be in line with or in the same plane as the jaws. For example, the handle may be offset relative to the jaws by an acute angle in the plane of the jaws, out of the plane of the jaws, or both. The wrench handle and the jaws may be made of separate pieces and connected by a wrist pin. The adjustment of the pin may allow pivoting of the handle upwards or downwards with respect to the plane of the wrench head. The wrench handle may be curved or may have other shapes.

The wrench may have a shortened handle embedded with a square hole to accommodate a torque wrench, e.g., which is known as a crowfoot design.

The wrench may have a wrench head, for example, the wrench head 2, on both ends of the wrench handle. Each wrench head can have a first and a second jaws and a movable plate mounted on the second jaw. The first jaw and the movable plate include work piece engaging surfaces that define an opening to receive work pieces. The wrench head on one end of the wrench handle can include an opening having a different size and/or shape than an opening included in the wrench head on the other end of the wrench handle. The two different openings can receive work pieces having different sizes or shapes.

Other than a coil spring, a flat spring, a flexure, or other types of springs that can engage with the pin and control the movement of the movable plate. The spring may be fixed to the wrench handle or the wrench head in other ways.

Other open-ended ratchet wrenches are described in U.S. Pat. Nos. 5,456,143, 5,829,327, 6,223,630, and 7,024,971, the entire contents of which are incorporated herein by reference. One or more components of the wrench described in these U.S. patents may be combined with, or incorporated into, the wrench described herein.

A number of embodiments have been described. Nevertheless, it will be understood that various modifications may be made.

Other embodiments not specifically described herein are also within the scope of the following claims.

What is claimed is:

1. An open-ended wrench comprising:

a handle; and a wrench head attached to the handle, the wrench head defining an opening to receive a work piece, the wrench head comprising:

a first jaw comprising at least a first surface to engage with a surface of the work piece;

a second jaw comprising a first curved surface facing the opening;

a plate mounted on the second jaw and movable relative the second jaw, the plate comprising at least a second surface to engage with another surface of the work piece, and the plate also comprising a second curved surface engaging the first curved surface and being slidable against the first curved surface, and a pin in a slot and movable within the slot to enable the second curved surface to slide against the first curved surface, the pin being restrained from contacting edges of the slot;

wherein the pin is fastened to the plate and the slot is in the second jaw, or the pin is fastened to the second jaw and the slot is in the plate;

wherein the plate has a center of rotation and the work piece has a center of rotation; and wherein the wrench head is configured so that, throughout motion of the wrench head, the center of rotation of the plate is between the center of rotation of the work piece and the handle, and the second jaw extends beyond both the center of rotation of the work piece and the center of rotation of the plate.

2. The open-ended wrench of claim 1, wherein the plate comprises a projection to partially enclose the opening.

3. The open-ended wrench of claim 1, wherein the first and the second curved surfaces have a same curvature.

4. The open-ended wrench of claim 1, wherein the second jaw comprises a supporting member extending from the first curved surface towards the opening.

5. The open-ended wrench of claim 4, wherein the plate comprises a proximal end and a distal end, and wherein the plate comprises plate members that are separated by an open space at the proximal end and joined at the distal end.

6. The open-ended wrench of claim 5, wherein the supporting member is accommodated in the open space between the plate members.

7. The open-ended wrench of claim 6, wherein the supporting member comprises the slot, and wherein the pin is fastened to the plate members and passes through the slot to connect the plate and the second jaw.

8. The open-ended wrench of claim 6, wherein one of the plate members comprises the slot, and the other plate member includes an additional slot, and wherein the pin is fastened to the supporting member and passes through the slots of the plate members.

9. The open-ended wrench of claim 1, wherein the slot is oriented so that the movement of the pin enables the second curved surface to slide against the first curved surface without disengaging the first and the second curved surfaces.

10. The open-ended wrench of claim 1, wherein the wrench head further comprises a spring having a first end attached to the wrench head and a second end to engage the plate.

11. The open-ended wrench of claim 1, wherein the first and the second surfaces are smooth surfaces.

12. The open-ended wrench of claim 11, wherein the first jaw and the plate have a six-point design.

13. The open-ended wrench of claim 1, wherein the first and the second surfaces are corrugated.

14. The open-ended wrench of claim 13, wherein the first jaw and the plate have a twelve-point design.

15. The open-ended wrench of claim 1, wherein the first jaw is stationary relative to the second jaw.

16. The open-ended wrench of claim 1, which is configured so that, during operation, torque is not transmitted through the pin.

17. A method of making an open-ended wrench comprising:

providing a base and a handle for a wrench head, the base comprising a first jaw and a second jaw that partially enclose an opening, the second jaw comprising a first curved surface facing the opening; and mounting a plate onto the second jaw, the plate being movable relative to the second jaw, wherein mounting the plate comprises engaging a second curved surface of the plate with the first curved surface of the second jaw, the second curved surface being slidable against the first curved surface, wherein mounting the plate onto the second jaw comprises extending a pin through a slot, the pin being movable within the slot to enable the second curved surface to slide against the first curved surface, the pin being restrained from contacting edges of the slot;

wherein the pin is fastened to the plate and the slot is in the second jaw, or the pin is fastened to the second jaw and the slot is in the plate;

wherein the plate has a center of rotation and the work piece has a center of rotation; and wherein the wrench head is configured so that, throughout motion of the wrench head, the center of rotation of the plate is between the center of rotation of the work piece and the handle, and the second jaw extends beyond both the center of rotation of the work piece and the center of rotation of the plate.

18. The method of claim 17, wherein the plate comprises a projection to partially enclose the opening.

19. The method of claim 17, wherein the open-ended wrench is configured so that, during operation, torque is not transmitted through the pin.

20. An apparatus comprising:

an open-ended wrench head having an opening between a first jaw and a movable plate mounted on a second jaw, the first and second jaws being connected to a handle, the movable plate having a locked state and comprising a curved surface engaging and slidable against a curved surface of a second jaw, the movable plate also comprising an overhanging member to partially enclose the opening, the overhanding member and the first jaw defining an entrance to the opening that has a width that is smaller in the locked state than in a non-locked state;

wherein the curved surface of the movable plate is slidable against the curved surface of the second jaw, without disengaging the curved surface of the second jaw and the curved surface of the movable plate, to move the movable plate away from the locked state and increase the width of the opening;

wherein after the work piece is loaded, the curved surface of the movable plate is slidable against the curved surface of the second jaw to allow the movable plate to move towards the locked state to grasp the work piece;

wherein the movable plate has a center of rotation and the work piece has a center of rotation; and wherein the open-ended wrench head is configured so that, throughout motion of the wrench head, the center of rotation of the plate is between the center of rotation of the work piece and the handle, and the second jaw extends beyond both the center of rotation of the work piece and the center of rotation of the plate.

21. The apparatus of claim 20, wherein the open-ended wrench is configured so that, during operation, torque is not transmitted through the pin.

* * * * *

UNITED STATES PATENT AND TRADEMARK OFFICE

CERTIFICATE OF CORRECTION

PATENT NO. : 8,342,063 B2
APPLICATION NO. : 12/646335
DATED : January 1, 2013
INVENTOR(S) : John L. Stanton It is certified that error appears in the above-identified patent and that said Letters Patent is hereby corrected as shown below:

In the Claims:

Claim 20, Column 10, line 25:

Delete "overhanding" and insert --overhanging--

Signed and Sealed this
Fourteenth Day of May, 2013

Teresa Stanek Rea
*Acting Director of the United States Patent and Trademark Office*